US009200496B2

(12) United States Patent
Reid

(10) Patent No.: US 9,200,496 B2
(45) Date of Patent: Dec. 1, 2015

(54) PRESSURE COMPENSATING DEVICE

(75) Inventor: Iain Reid, Portishead (GB)

(73) Assignee: Viper Subsea Technology Limited, Portishead, Bristol (GB)

( * ) Notice: Subject to any disclaimer, the term of this patent is extended or adjusted under 35 U.S.C. 154(b) by 505 days.

(21) Appl. No.: 13/427,187

(22) Filed: Mar. 22, 2012

(65) Prior Publication Data

US 2012/0241009 A1 Sep. 27, 2012

(30) Foreign Application Priority Data

Mar. 24, 2011 (GB) ..... 1104953.3

(51) Int. Cl.
*E21B 33/035* (2006.01)
*E21B 33/037* (2006.01)

(52) U.S. Cl.
CPC ..... *E21B 33/0355* (2013.01); *E21B 33/037* (2013.01); *Y10T 137/0318* (2015.04)

(58) Field of Classification Search
CPC ..... E21B 33/0355; E21B 33/037
USPC ..... 137/493.9, 516.25, 516.27; 251/33–44, 251/54; 60/475, 592; 138/31
See application file for complete search history.

(56) References Cited

U.S. PATENT DOCUMENTS

| | | | | |
|---|---|---|---|---|
| 347,856 | A * | 8/1886 | Wielding | 251/38 |
| 2,418,634 | A * | 4/1947 | Hallerstrom | 137/493.9 |
| 3,595,012 | A * | 7/1971 | Beck, Jr. | 60/398 |
| 3,785,612 | A * | 1/1974 | Schertler | 251/43 |
| 2003/0037544 | A1 | 2/2003 | Armstrong | |
| 2006/0231265 | A1 | 10/2006 | Martin | |
| 2009/0133930 | A1 | 5/2009 | Thorp et al. | |

OTHER PUBLICATIONS

Search Report for GB1104953.3 dated May 3, 2011.

* cited by examiner

*Primary Examiner* — Kevin Murphy
*Assistant Examiner* — Daphne M Barry
(74) *Attorney, Agent, or Firm* — Andrus Intellectual Property Law, LLP

(57) ABSTRACT

A pressure compensating device for compensating fluid pressure within a sealed enclosure comprises a cylinder divided into a first chamber and a second chamber by a piston, wherein:

the first chamber communicates with the enclosure and the second chamber communicates with the environment;

the piston is arranged to adjust the relative volumes of the first and second chambers in response to a difference in pressure between the said chambers by moving within the cylinder; and the piston is arranged to allow fluid communication between the enclosure and the environment when the piston is in at least one position within the cylinder.

12 Claims, 1 Drawing Sheet

PRESSURE COMPENSATING DEVICE

This invention relates to a device for equalizing pressure in subsea equipment.

Subsea controls equipment is typically installed with subsea oil and gas Christmas trees and manifolds to control valves and monitor instrumentation. Subsea controls equipment is typically deployed at depths of up to 4000 m. It is common practice to enclose subsea controls equipment in a sealed, insulating oil filled enclosure which provides a benign environment to protect the internal electronic/hydraulic components from the hostile subsea environment.

It is necessary to pressure compensate oil filled subsea controls equipment enclosures to match the external pressure at the equipment deployment depth. This is commonly achieved using bladder or piston pressure compensators. The pressure compensators have ports open to seawater on one side and a barrier (bladder/piston) separating the seawater from the insulating oil. As the equipment is deployed subsea the external pressure increases with depth and the seawater presses the bladder or piston against the insulating oil, thereby substantially equalising the pressure of the internal oil filled enclosure to the external pressure of the seawater at the deployed depth.

Subsea controls equipment has a storage temperature range of −18° C. to 50° C. (as per the relevant ISO standard). Over this operating temperature range there may be a large variation in the volume of insulating oil in the oil filled controls equipment enclosure due to thermal expansion of the insulating oil. The volume of compensation required and the volume of oil is carefully calculated based on the operating depth and volume change due to variations in temperature.

To protect the oil filled enclosure against internal overpressure which may arise due to an increase in oil volume at elevated temperatures, it is known to fit relief valves to oil filled subsea controls enclosures to vent oil in the event of over-pressure to prevent damage to the enclosure.

If there is not enough oil in the oil filled enclosure upon deployment, for example due to operator error during the filling process or a leak, a pressure differential may build up across the enclosure as the equipment is deployed to depth. This pressure differential can cause the enclosure to implode and damage the internal components. Relief valves to protect the subsea controls enclosure from such under-pressure (i.e. to let in seawater) are known, but they are exposed to seawater and are susceptible to calcareous deposits. In the applicant's experience these relief valves have been known to either not operate or, when they do operate, not to re-seat to protect the enclosure from further seawater ingress after the pressure has equalised.

According to a first aspect of the present invention there is provided a pressure compensating device for compensating fluid pressure within a sealed enclosure comprising a cylinder divided into a first chamber and a second chamber by a piston, wherein: the first chamber communicates with the enclosure and the second chamber communicates with the environment; the piston is arranged to adjust the relative volumes of the first and second chambers in response to a difference in pressure between the said chambers by moving within the cylinder; and the piston is arranged to allow fluid communication between the enclosure and the environment when the piston is in at least one position within the cylinder.

The fluid communication between the enclosure and the environment may take place via the first and second chamber of the cylinder.

The piston may allow fluid communication between the first and second chamber when it is substantially at at least one of the limits of its movement range.

A flow path may be provided past the piston to allow fluid communication when the piston is substantially at at least one of the limits of its movement range.

The flow path may comprise at least one groove or recess in the interior cylinder wall.

A flow path may be provided when the piston is at both of the limits of its movement range.

The piston may be arranged to allow fluid communication in response to over-pressure or under-pressure in the enclosure relative to the environment.

At least one spring may be provided which urges the piston away from a position in which it allows fluid communication. The at least one spring may be arranged to be disengaged when the piston is remote from the position in which fluid communication is allowed.

The at least one spring may be mounted on the piston.

A feature may be provided on the piston that engages with a setting tool to allow the position of the piston to be set using the setting tool via a port in the second chamber.

The initial volume of the first chamber may be set by adjusting the position of the piston.

A spring may be provided to bias the pressure within the enclosure relative to the environment.

According to a second aspect of the invention, a method is provided of filling an enclosure to which a pressure compensating device according to a first aspect of the invention is connected, the method comprising the step of moving or cycling the piston through at least part of its range of movement within the cylinder using the setting tool to thereby purge air from the enclosure prior to sealing of the enclosure.

The enclosure may be filled at atmospheric pressure.

The present invention will now be described, by way of example, with reference to the following drawings in which.

Figure 1:
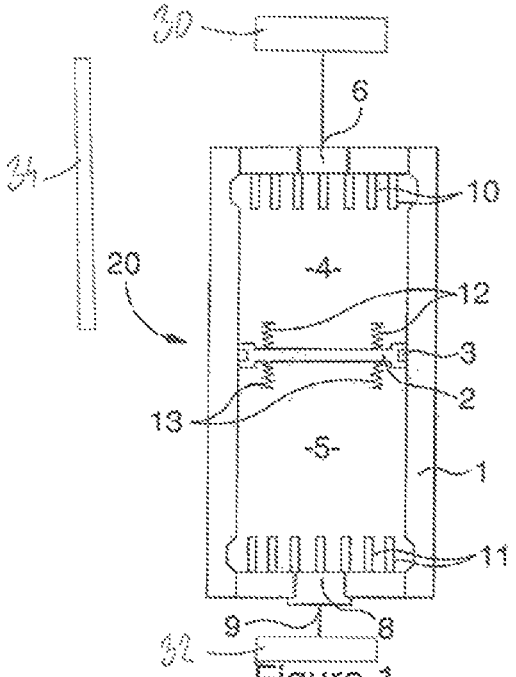
FIG. 1 is a schematic view of an embodiment of the invention in which the piston is in a central position and the subsea controls enclosure is sealed.

FIG. 1 shows a pressure compensator 20, comprising a cylinder 1, within which is housed a piston 2. A seal 3 is disposed within a groove on the piston 2 to provide a seal between a first chamber 4 and a second chamber 5 of the cylinder. The cylinder 1 comprises a first end wall which is provided with an oil port 6 and which closes the first chamber 4, and a second end wall which is provided with an external port 8 and which closes the second chamber 5. The end walls additionally act as end stops, limiting the range of movement of the piston 2 within the cylinder 1. A gauze or filter element 9 may be provided at the external port 8 to protect the device against marine growth or sealife which may otherwise enter the second chamber 5.

Biasing means in the form of springs 12, 13 are fitted on each side of the piston 2 within the first chamber 4 and second chamber 5 respectively. A first set of grooves 10 are provided in the interior of the cylinder near the first end wall and a second set of grooves 11 are similarly provided near the second end wall.

The cylinder 1 and the piston 2 may comprise a non-metallic material. The first chamber 4 communicates, in use, with an oil filled controls equipment enclosure via the oil port 6 and the second chamber 5 communicates, in use, with seawater environment 32 via the external port 8. The grooves 10, 11 are arranged such that when the piston 2 is at the end of its travel, fluid may be transferred past the piston seal 3 via the grooves.

The springs 12 are arranged to make contact with the first end wall before the piston has reached the end of its travel in a first direction, and must be compressed before the piston 2 reaches a position in which the grooves 10 allow fluid communication between the first and second chambers. Similarly, the springs 13 are arranged such that they make contact with the second end wall before the piston has reached the end of its travel in a second direction, and must be compressed before the piston 2 reaches a position in which the grooves 11 allow fluid communication between the first and second chambers.

The design of the springs 12, 13, grooves 10, 11 and cylinder 1 may be specified such that a specific pressure differential between the first chamber 4 and second chamber 5 is required before fluid communication is allowed between the two chambers. It will be appreciated that it is possible to arrange for the pressure threshold to be different in respect of over-pressure and under-pressure in the oil filled controls equipment enclosure 30. It will further be appreciated that other arrangements of springs can be used, for instance the springs may be fixed to the cylinder rather than the piston. Furthermore the springs may take a range of forms.

When at or close to the limits of piston travel, the springs 12, 13 serve to urge the piston 2 from a position in which fluid communication can take place via the grooves 10, 11 to a position in which the first chamber 4 is sealed from the second chamber by the piston seal 3. When the pressure differential between the first and second chamber is between the over-pressure threshold and the under-pressure threshold, the first chamber 4, and therefore the enclosure, will remain sealed by the piston seal 3.

Additional springs (not shown) may be arranged to provide a pressure pre-load to the oil filled controls equipment enclosure. Such springs may be arranged so that the pressure within the oil filled controls equipment enclosure remains within a defined range throughout the range of movement of the piston 2. It will be appreciated by one skilled in the art that a number of arrangements of springs are possible in order to achieve appropriate pressure pre-loads in addition to appropriate over and under-pressure thresholds.

The initial position of the piston 2 within the cylinder 1 may be set manually using a setting rod 34. This initial position determines the initial volume of compensation oil in the cylinder 1. The setting rod 34 may have a threaded end and be inserted through the seawater port 8 and engage with a tapped hole feature (not shown) on the piston 2. The volume of oil in the compensating cylinder 1 is set by moving the piston 2 to a calculated length in its range of travel. The position of the piston 2 may be determined by measuring the length of setting rod inserted through the cylinder seawater port 8. The piston 2 may be cycled through its range of travel using the setting rod 34 to displace air from the cylinder through the oil port 6 and hoses or the like connected thereto and thereby purge air out of the oil in the compensating circuit, allowing the controls enclosure to be gravity filled and removing the need for vacuum filling of the controls enclosure which has previously been required to eliminate air from the system. Such an arrangement further removes the need to adjust the volume within the compensating circuit by pressurising the enclosure on filling, as is the case in typical prior art pressure compensators which are spring biased and do not include such a setting feature.

FIG. 1 shows the piston 2 in a central position within the cylinder 1, and the first chamber 4 is sealed by the piston seal 3. Seawater enters the second chamber 5 when the device is deployed subsea, and the external pressure from the seawater pushes the piston against the controls enclosure oil, thereby equalising the pressure inside the controls enclosure with the seawater pressure at the deployment depth (in the absence of a pressure pre-load).

Provided that quantity of oil provided in the system is correct, the grooves will not come into play and the piston serves to maintain a barrier between the oil and water whilst delivering pressure compensation therebetween. When the springs are not engaged with the cylinder ends the piston is free to move to equalise the pressures in the first and second chambers and the pressure difference between the first and second chamber is substantially zero.

Figure 2:
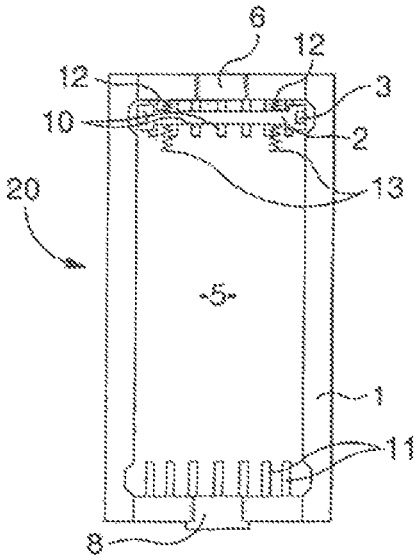
FIG. 2 is a schematic view of an embodiment of the invention in which the piston is occupying a position in which seawater may be admitted to the controls enclosure.
Figure 3:
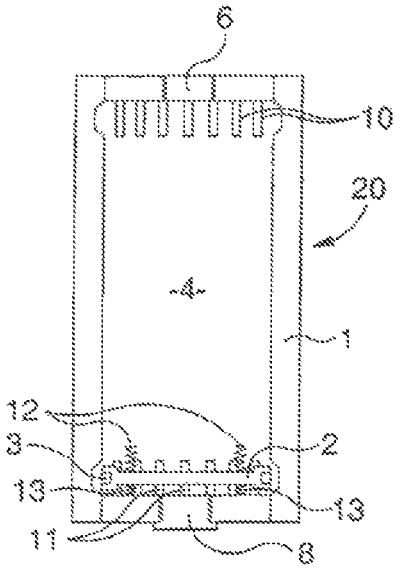
FIG. 3 is a schematic view of an embodiment of the invention in which the piston is occupying a position in which oil may escape from the controls enclosure.

If there is not enough oil in the pressure compensator to allow the piston to pressure compensate for an under-pressure in the controls enclosure, the piston may be pushed to a position at or near the end stops of the cylinder. In FIG. 2, the piston is shown in a position corresponding to an under-pressure in the oil filled enclosure. The differential pressure on the piston 2 has resulted in the movement of the piston towards the oil port 6 bringing the springs 12 into engagement with the first end wall, further movement resulting in compression of the springs 12 such that communication can take place between the first chamber 4 and the second chamber 5 via the grooves 10. The piston seal no longer provides an effective seal with the cylinder wall due to the grooves machined in the cylinder wall. The grooves allow seawater to pass into the controls enclosure reducing the pressure difference between the seawater and the controls enclosure, thereby also protecting the integrity of the controls enclosure.

As shown in FIG. 2, when the under-pressure in the enclosure has reduced sufficiently, the springs 12 will urge the piston back to a position in which the piston seal 4 is in contact with the cylinder walls to provide an effective seal and prevent further seawater ingress.

If there is too much insulating oil in the pressure compensator at elevated temperatures the insulating oil may expand, increasing the pressure in the controls enclosure above that of the ambient pressure. The resulting oil pressure pushes the piston 2 towards the external port 8 compressing the springs 13. The piston seal 3 no longer provides an effective seal between the cylinder wall and the piston 2 due to the grooves 11 machined in the cylinder wall. The grooves 11 provide a flow path allowing oil to pass into the surrounding environment reducing the over-pressure and thereby protecting the integrity of the controls enclosure. It will be appreciated that this manner of operation is extremely similar to that described before.

When the over-pressure has sufficiently reduced, the compressed spring 13 pushes the piston seal 3 back, off the grooves 11, into contact with the cylinder walls providing an effective seal and preventing further oil loss.

While the cylinder has been described with two sets of grooves in order to relieve over-pressure and under-pressure, in alternative arrangements a single set of grooves may be employed such that only over-pressure relief or only under-pressure relief is provided.

In an alternative arrangement, the flow path for over-pressure and/or under-pressure relief may be provided by a channel between flow ports in the wall of the cylinder.

Whilst the description hereinbefore is of a specific example embodiment of the invention, it will be appreciated that a wide range of modifications and alterations may be made thereto without departing from the scope of the invention.

The invention claimed is:

1. A pressure compensating device for compensating fluid pressure within a sealed enclosure, the pressure compensation device comprising a cylinder divided into a first chamber and a second chamber by a piston, the piston being movable within and supported for movement by the cylinder through a permitted range of movement, the piston being housed entirely within the cylinder such that no part thereof or integer movable therewith projects from the cylinder, in use, wherein:

the first chamber communicates with the enclosure and the second chamber communicates with the environment;

other than when the piston is at or near at least one end of the permitted range of movement, the piston is arranged to adjust the relative volumes of the first and second chambers in response to a difference in pressure between the said chambers by moving within the cylinder without permitting fluid communication therebetween; and the piston being arranged to allow fluid communication between the first and second chambers, and hence between the enclosure and the environment, only when the piston is at or near at least one end of the permitted range of movement, wherein a flow path is provided past the piston to allow fluid communication when the piston is at or near an end of the permitted range of movement of the piston, the flow path being defined between the piston and at least one axial groove in an inner wall of the cylinder.

2. A device according to claim 1 wherein the flow path is provided when the piston is at both of the limits of the movement range of the piston.

3. A device according to claim 1 wherein the piston is arranged to allow fluid communication in response to over-pressure or under-pressure in the enclosure relative to the environment.

4. A pressure compensating device for compensating fluid pressure within a sealed enclosure, the pressure compensation device comprising a cylinder divided into a first chamber and a second chamber by a piston, the piston being moveable within and supported for movement by the cylinder through a permitted range of movement, the piston being housed entirely within the cylinder such that no pan thereof or integer movable therewith projects from the cylinder, in use, wherein:

the first chamber communicates with the enclosure and the second chamber communicates with the environment;

other than when the piston is at or near at least one end of the permitted range of movement, the piston is arranged to adjust the relative volumes of the first and second chambers in response to a difference in pressure between the said chambers by moving within the cylinder without permitting fluid communication therebetween; and the piston being arranged to allow fluid communication between the first and second chambers, and hence between the enclosure and the environment, only when the piston is at or near at least one end of the permitted range of movement, wherein at least one spring is provided which urges the piston away from a position in which the piston allows fluid communication, and wherein a flow path is provided past the piston to allow fluid communication when the piston is at or near an end of the permitted range of movement of the piston, the flow path being defined between the piston and at least one axial groove in an inner wall of the cylinder.

5. A device according to claim 4 wherein the at least one spring is arranged to be disengaged when the piston is remote from the position in which fluid communication is allowed.

6. A device according to claim 4 wherein the at least one spring is mounted on the piston.

7. A pressure compensating device for compensating fluid pressure within a sealed enclosure, the pressure compensation device comprising a cylinder divided into a first chamber and a second chamber by a piston, the piston being movable within and supported for movement by the cylinder through a permitted range of movement, the piston being housed entirely within the cylinder such that no part thereof or integer movable therewith projects from the cylinder, in use, wherein:

the first chamber communicates with the enclosure and the second chamber communicates with the environment;

other than when the piston is at or near at least one end of the permitted range of movement, the piston is arranged to adjust the relative volumes of the first and second chambers in response to a difference in pressure between the said chambers by moving within the cylinder without permitting fluid communication therebetween; and the piston being arranged to allow fluid communication between the first and second chambers, and hence between the enclosure and the environment, only when the piston is at or near at least one end of the permitted range of movement, wherein a feature is provided on the piston that engages with a setting tool to allow the position of the piston to be set using the setting tool via a port in the second chamber, and wherein a flow path is provided past the piston to allow fluid communication when the piston is at or near an end of the permitted range of movement of the piston, the flow path being defined between the piston and at least one axial groove in an inner wall of the cylinder.

8. A pressure compensating device for compensating fluid pressure within a sealed enclosure, the pressure compensation device comprising a cylinder divided into a first chamber and a second chamber by a piston, the piston being movable within and supported for movement by the cylinder through a permitted range of movement, the piston being housed entirely within the cylinder such that no part thereof or integer movable therewith projects from the cylinder, in use, wherein:

the first chamber communicates with the enclosure and the second chamber communicates with the environment;

other than when the piston is at or near at least one end of the permitted range of movement, the piston is arranged to adjust the relative volumes of the first and second chambers in response to a difference in pressure between the said chambers by moving within the cylinder without permitting fluid communication therebetween; and the piston being arranged to allow fluid communication between the first and second chambers, and hence between the enclosure and the environment, only when the piston is at or near at least one end of the permitted range of movement, wherein the initial volume of the first chamber is set by adjusting the position of the piston, and wherein a flow path is provided past the piston to allow fluid communication when the piston is at or near an end of the permitted range of movement of the piston, the flow path being defined between the piston and at least one axial groove in an inner wall of the cylinder.

9. A pressure compensating device for compensating fluid pressure within a sealed enclosure, the pressure compensation device comprising a cylinder divided into a first chamber and a second chamber by a piston, the piston being movable within and supported for movement by the cylinder through a permitted range of movement the piston being housed entirely within the cylinder such that no part thereof or integer movable therewith projects from the cylinder, in use, wherein:

the first chamber communicates with the enclosure and the second chamber communicates with the environment;

other than when the piston is at or near at least one end of the permitted range of movement, the piston is arranged to adjust the relative volumes of the first and second chambers in response to a difference in pressure between the said chambers by moving within the cylinder without permitting fluid communication therebetween; and the piston being arranged to allow fluid communication between the first and second chambers, and hence between the enclosure and the environment, only when the piston is at or near at least one end of the permitted range of movement, wherein a spring is provided to bias the piston against the pressure within the enclosure relative to the environment, and wherein a flow path is provided past the piston to allow fluid communication when the piston is at or near an end of the permitted range of movement of the piston, the flow path being defined between the piston and at least one axial groove in an inner wall of the cylinder.

10. A method of filling an enclosure connected to a pressure compensating device for compensating fluid pressure within the enclosure, the pressure compensating device being of the type comprising a cylinder divided into a first chamber and a second chamber by a piston, wherein the first chamber communicates with the enclosure and the second chamber communicates with the environment, the piston being arranged to adjust the relative volumes of the first and second chambers in response to a difference in pressure between the said chambers by moving within the cylinder, the piston being arranged to allow fluid communication between the enclosure and the environment when the piston is in at least one position within the cylinder, a feature being provided on the piston that engages with a setting tool to allow the position of the piston to be set using the setting tool via a port in the second chamber, the method comprising the step of moving or cycling the piston through at least part of its range of movement within the cylinder using the setting tool to thereby purge air from the enclosure prior to sealing of the enclosure.

11. The method of claim 10 in which the enclosure is filled at atmospheric pressure.

12. A pressure compensating device for compensating fluid pressure within a sealed enclosure, the pressure compensating device comprising a cylinder divided into a first chamber and a second chamber by a piston, the piston being movable within the cylinder through a permitted range of movement, the piston being housed entirely within the cylinder such that no part thereof or integer movable therewith projects front the cylinder, in use, wherein:

the first chamber communicates with the enclosure and the second chamber communicates with the environment;

other than when the piston is at or near at least one end of the range of permitted movement, the piston is arranged to adjust the relative volumes of the first and second chambers in response to a difference in pressure between the said chambers by moving within the cylinder without permitting fluid communication therebetween; and the piston being arranged to allow fluid communication between the first and second chambers, and hence between the enclosure and the environment, only when the piston is at or near at least one end of the range of permitted movement, wherein at least one spring is provided which urges the piston away from a position in which the piston allows fluid communication, wherein the at least one spring is arranged to be disengaged when the piston is remote from the position in which fluid communication is allowed.

* * * * *